United States Patent [19]

Shaffer

[11] 4,244,295

[45] Jan. 13, 1981

[54] RADIANT ENERGY ACTIVATED PYROTECHNIC CAP HAVING DESICCANT THEREIN

[75] Inventor: John W. Shaffer, Williamsport, Pa.

[73] Assignee: GTE Products Corporation, Stamford, Conn.

[21] Appl. No.: 2,265

[22] Filed: Jan. 10, 1979

[51] Int. Cl.[3] ..... F92C 19/08

[52] U.S. Cl. ..... 102/205; 102/27; 149/37; 149/15

[58] Field of Search ..... 102/29, 205; 149/2, 149/15–18, 37

[56] References Cited

U.S. PATENT DOCUMENTS

| | | | |
|---|---|---|---|
| 2,036,511 | 4/1936 | Vanderpool et al. | 102/29 |
| 2,909,121 | 10/1959 | Gernert et al. | 102/29 X |
| 2,985,979 | 5/1961 | Doyle et al. | 42/1 N |
| 3,118,798 | 1/1964 | Winckler | 149/37 X |
| 3,667,992 | 6/1972 | Brown et al. | 149/16 X |
| 3,849,923 | 11/1974 | Hawkins | 42/1 N |
| 4,130,082 | 12/1978 | Bouchard et al. | 116/5 |
| 4,160,062 | 7/1979 | Gawlick et al. | 149/15 X |

FOREIGN PATENT DOCUMENTS

| | | | |
|---|---|---|---|
| 1424524 | 5/1972 | United Kingdom | 149/29 |

OTHER PUBLICATIONS

*Condensed Chemical Dictionary,* Van Nostrand Reinhold Co., 1977, p. 820.

*Primary Examiner*—Peter A. Nelson
*Attorney, Agent, or Firm*—Lawrence R. Fraley

[57] ABSTRACT

An improved pyrotechnic cap capable of being activated by the radiant energy from an adjacent flashlamp. The cap includes a plastic container with a quantity of pyrotechnic composition hermetically sealed therein. Receipt of the described radiant energy causes activation of the composition whereby the cap produces an audible signal of high intensity (e.g. 158 to 164 decibels at 25 centimeters). The improvement comprises adding a desiccant material within the cap's container atop the pyrotechnic composition to absorb any quantities of moisture which might enter the container and adversely affect the cap's operability.

8 Claims, 1 Drawing Figure

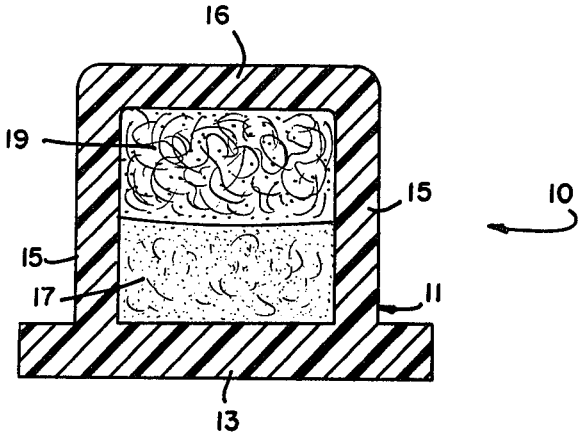
16
19
15
10
15
17
11
13

RADIANT ENERGY ACTIVATED PYROTECHNIC CAP HAVING DESICCANT THEREIN

CROSS-REFERENCE TO COPENDING APPLICATIONS

An application under Ser. No. 2,263 was filed Jan. 10, 1979. Ser. No. 2,263 entitled "Heat-Sealed Pyrotechnic Cap and Method of Making" (Inventors: A. C. Bouchard et al), describes a method for providing a hermetic seal in the end of a plastic cap containing a quantity of radiant energy activated pyrotechnic material therein. The formed cap may include a nonreactive filler located therein separate from and atop the pyrotechnic material to serve as a support for the sealed end.

An application under Ser. No. 2,264 was also filed Jan. 10, 1979. Ser. No. 2,264 entitled "Pyrotechnic Cap With Mechanically Desensitized Composition" (Inventors: T. L. Gavenonis et al), defines a cap wherein the pyrotechnic composition includes a quantity of desensitizing material which serves to substantially decrease the cap's sensitivity to ingition by mechanical impact.

An application under Ser. No. 2,272 entitled "Pyrotechnic Cap With Moisture Indicator" (Inventors: A. C. Bouchard et al) was also filed Jan. 10, 1979. In Ser. No. 2,272, a pyrotechnic cap is provided with a changing member to indicate the presence of moisture within the cap's container.

In addition to the above, an application entitled "Flashlamp Assembly For Providing Highly Intense Audible and Visual Signals" (Inventors: A. C. Bourchard et al) was filed June. 6, 1977 and is now U.S. Pat. No. 4,130,082. U.S. Pat. No. 4,130,082 describes a hermetically sealed pyrotechnic cap adapted for being activated by the light and/or heat from a chemical flashlamp. U.S. Pat. No. 4,130,082 is assigned to the same assignee as the instant invention, as are the aforementioned copending applications.

BACKGROUND OF THE INVENTION

The invention relates to pyrotechnic caps and particularly to hermetically-sealed pyrotechnic caps capable of being activated by radiant energy in the form of light and/or heat.

In the aforementioned U.S. Pat. No. 4,103,082, there is described a unique concept in the production of substantially simultaneous, high intensity audible and visual signals. As described in U.S. Pat. No. 4,130,082, it has been discovered that hermetically sealed plastic caps having a pyrotechnic composition therein can be instantaneously activated by the highly intense light and/or heat from an adjacent flashlamp to produce an audible signal also of high intensity (e.g. approaching 165 decibels). The preferred activating flashlamps are those presently utilized in the photoflash products manufactured and sold by the assignee of the instant invention under the name MAGICUBE. As also described in U.S. Pat. No. 4,130,082, it is possible to activate the sealed caps using other varieties of flashlamps such as those which are electrically activated. One example of this latter type are the flashlamps currently utilized in the photoflash products manufactured and sold by the assignee of the instant invention under the name FLIP-FLASH.

A primary use for the device in U.S. Pat. No. 4,120,082 is an intrusion alarm. The device may also comprise part of an alarm system wherein a suitable detector is used to receive the device's output and thereafter perform an auxillary function (e.g. emit a prolonged, high intensity signal). Quite understandably, devices such as alarm systems must possess a high degree of reliability. Accordingly, it is essential that the cap member which comprises an integral part of the device must also possess a similar functioning capability.

It has been determined that the presence of moisture within the cap, even in relatively minor quantities, can adversely affect both the cap's reliability and the loudness of the emitted audible signal. This moisture may enter the cap either during manufacture thereof or subsequent to said manufacture by penetration of a defective seal.

It is also known that water vapor is capable of permeating the polymeric side walls of the cap's container upon prolonged exposure of the cap to extreme conditions of high temperature and humidity.

It is believed, therefore, that a pyrotechnic cap member capable of compensating for the presence of moisture therein to thereby assure that the required functional reliability and loudness characteristics of said member will be maintained would constitute a significant advancement in the art.

OBJECTS AND SUMMARY OF THE INVENTION

It is, therefore, a primary object of the present invention to provide a pyrotechnic cap capable of compensating for the presence of moisture therein.

In accordance with one aspect of the invention, there is provided an improved pyrotechnic cap which is capable of being activated by the radiant energy from an adjacent flashlamp to in turn produce an audible signal of high intensity. The improvement comprises adding a desiccant within the sealed cap's plastic container adjacent the pyrotechnic composition. The desiccant acts as a getter and prolongs retention of the pyrotechnic composition in a dry, fully active state, thereby benefiting both firing reliability and loudness.

BRIEF DESCRIPTION OF THE DRAWING

The drawing is an elevational view, in section, of a pyrotechnic cap member in accordance with a preferred embodiment of the invention.

DETAILED DESCRIPTION OF THE PREFERRED EMBODIMENTS

For a better understanding of the present invention together with other and further objects, advantages, and capabilities thereof, reference is made to the following disclosure and appended claims in connection with the above-described drawing.

With particular reference to the drawing, there is shown a pyrotechnic cap member 10 which comprises a plastic container 11 which in crosssection includes a base portion 13, at least two upstanding sides 15, and a hermetically-sealed end portion 16. (One method of providing container 11 with a sealed end is disclosed in the copending application under Ser. No. 2,263). The plastic material for container 11 is a thermoplastic preferably high density polyethylene. It is understood, however, that other plastic could be used, including low density polyethylene, polypropylene, polyvinyl chloride, polycarbonates, etc. The container as shown is preferably cylindrical in configuration but could, of course, assume other shapes, including rectangular, hexagonal, etc.

Cap 10 includes a quantity of pyrotechnic composition 17 which is hermetically sealed within container 11. Examples of suitable pyrotechnic materials for use in the invention are described in the aforementioned U.S. Pat. No. 4,130,082. A preferred material is one containing potassium chlorate, red phosphorous, manganese dioxide, and a dispersing agent (to be further defined below). Pyrotechnic materials known as "Armstrong's Mixtures" may also be used with the present invention. These compositions typically include potassium chlorate within the range of about 67 to 81 percent, phosphorous from about 8 to 27 percent, sulfur from about 3 to 9 percent, and precipitated chalk from about 3 to 11 percent. All of these percentages are by weight of the material.

As an alternate embodiment, it may be desirable to use a pyrotechnic mixture which emits a "whistling" or similar sound. Such materials are well known in the art and may contain potassium chlorate, potassium perchlorate, potassium nitrate, red gum, gallic acid, potassium picrate, potassium benzoate, potassium dinitrophenate and sodium salicylate. These formulations are shown on pages 376 and 377 of the book entitled "Military and Civilian Pyrotechnics" by Dr. Herbert Ellern, copyright 1968 by The Chemical Publishing Co., Inc. The aforementioned "Armstrong's Mixtures" are defined on page 353 of this text.

The above nonwhistling materials assure an audible signal of high intensity when the cap is activated by the energy from an adjacent flashlamp. By high intensity is meant an output of above 85 decibels measured at a distance of 25 centimeters. The preferred range when cap 10 is utilized in the aforedescribed invention is from about 158 to about 164 decibels at this distance.

For toxicity consideration, compostions including red phosphorous and potassium chlorate are preferred. One disadvantage of red phosphorous, however, is that it possesses a tendency to prematurely degrade when in the presence of even minor quantities of moisture, particularly in the presence of traces of degradation-catalyzing metals such as iron and copper. These metals may be found in even the most purified commercial grades of red phosphorous. The end result of such degradation is that the cap's ability to be activated by absorbed radiant energy, as well as the rate of burning of the member upon said activation, is adversely affected. Burning rate, in turn, affects the level and uniformity of the generated audible signal. Furthermore, the presence of excessive amounts of moisture can result in the cap becoming totally inoperable for the purpose defined.

The present invention substantially eliminates the above deleterious effects. It has been found, quite unexpectedly, that the addition of a quantity of desiccating material 19 to the cap before sealing the plastic container substantially enhances the operability of the finished product by improving the cap's reliability and assuring uniformity of loudness of the emitted signal. And these features are provided without an adverse affect on the cap's ability to respond to the activating radiant energy. Material 19 is located above the pyrotechnic composition and adjacent thereto. As such, material 19 is also located immediately adjacent the cap's sealed end 16.

It is important that desiccant material 19 be nondeliquescent; that is, it must not gradually dissolve or become liquid as a result of its attraction and absorption of moisture. Accordingly, a material such as calcium chloride would not prove suitable.

The preferred desiccant for use in the instant invention is a material having a high internal absorbing surface area. Of these, the most preferred is activated alumina. To caps containing approximately eleven milligrams of one of the above pyrotechnic compositions, quantities ranging from about 1 to 20 milligrams of activated alumina powder were added prior to cap sealing. Other suitable materials of the above variety include silica gel and molecular sieves, both preferably, in powdered form. A preferred molecular sieve may be purchased from the Union Carbide Corporation, New York, N.Y. under the product number 3A. This material is available in powder form (600 mesh) and as pellets (0.0625 and 0.125 diameter).

It is further possible in the invention to use hydrate-forming salts as the desiccant. Of these, anhydrous calcium sulfate and magnesium sulfate are preferred. Reactive desiccants which undergo chemical reaction with moisture may be used. Suitable examples include the oxides of calcium, strontium, and barium.

The desiccant may be incorporated within cap member 10 in the form of a powder (as described) or a pellet. It is also possible to utilize a disc of desiccant-impregnated paper. In either event, the desiccant is added to the cap after the pyrotechnic composition has been deposited therein. This composition is usually deposited in slurry form and thereafter dried. Understandably, the desiccant would not be added until the pyrotechnic composition had assumed a completely dry state.

There has thus been described a substantially improved pyrotechnic cap capable of being activated by the intense light from an adjacent flash-lamp. The improvement constitutes the addition of a desiccating material to the cap's container adjacent the desired pyrotechnic composition. The addition of such material substantially assures prevention of pyrotechnic composition degradation in high humidity environments without adversely affecting the degree of uniformity of the cap's audible signal. The desiccant material also does not adversely affect the ability of the sealed cap to receive the requisite, activating radiant energy.

While there have been shown and described what are at present considered the preferred embodiments of the invention, it will be obvious to those skilled in the art that various changes and modifications may be made therein without departing from the scope of the invention as defined by the appended claims.

I claim:

1. In a pyrotechnic cap for providing an audible signal of high intensity upon receipt of energy in the form of light and/or heat from a flashlamp wherein said cap includes a plastic container having a pyrotechnic composition hermetically sealed therein separately from said flashlamp, the improvement wherein said container further includes a quantity of a nondeliquescent desiccating material therein, said material located adjacent said pyrotechnic composition.

2. The improvement according to claim 1 wherein said desiccating material is selected from the group consisting of activated alumina, molecular sieves, and silica gels.

3. The improvement according to claim 1 wherein said desiccating material is a hydrate-forming salt.

4. The improvement according to claim 4 wherein said hydrate-forming salt is selected from the group consisting of anhydrous calcium sulfate and magnesium sulfate.

5. The improvement according to claim 1 wherein said desiccating material is selected from the group consisting of barium oxide, calcium oxide, and strontium oxide.

6. The improvement according to claim 1 wherein said desiccating material is a powder.

7. The improvement according to claim 1 wherein said desiccating material is in pellet form.

8. The improvement according to claim 1 further including a paper disc within said container, said desiccating material impregnated within said disc.

* * * * *